US008962228B2

(12) United States Patent
Iftime et al.

(10) Patent No.: US 8,962,228 B2
(45) Date of Patent: Feb. 24, 2015

(54) LOW MELT COLOR TONERS WITH FLUORESCENCE AGENTS

(75) Inventors: Gabriel Iftime, Mississauga (CA); Karen A. Moffat, Brantford (CA); Jordan H. Wosnick, Toronto (CA); Eric Rotberg, Toronto (CA); Cuong Vong, Hamilton (CA); Richard P. N. Veregin, Mississauga (CA); Peter M. Kazmaier, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 248 days.

(21) Appl. No.: 12/724,582

(22) Filed: Mar. 16, 2010

(65) Prior Publication Data

US 2010/0173239 A1 Jul. 8, 2010

Related U.S. Application Data

(63) Continuation-in-part of application No. 12/234,110, filed on Sep. 19, 2008.

(51) Int. Cl.

| | |
|---|---|
| ***G03G 9/09*** | (2006.01) |
| ***G03G 9/087*** | (2006.01) |
| ***G03G 9/08*** | (2006.01) |

(52) U.S. Cl.

CPC ..... *G03G 9/08795* (2013.01); *G03G 9/0806* (2013.01); *G03G 9/0821* (2013.01); *G03G 9/08755* (2013.01); *G03G 9/08797* (2013.01); *G03G 9/0906* (2013.01); *G03G 9/0926* (2013.01)

USPC ..... 430/107.1; 430/108.4; 430/108.7; 430/137.1

(58) Field of Classification Search

CPC ..... G03G 9/08795; G03G 9/0806; G03G 9/0821; G03G 9/08755

USPC ..... 430/108.4, 108.7, 137.14

See application file for complete search history.

(56) References Cited

U.S. PATENT DOCUMENTS

| | | | | |
|---|---|---|---|---|
| 5,128,525 | A | 7/1992 | Stearns et al. | |
| 5,168,147 | A | 12/1992 | Bloomberg | |
| 5,554,480 | A | 9/1996 | Patel et al. | |
| 5,755,860 | A | 5/1998 | Zhu | |
| 5,837,042 | A | 11/1998 | Lent et al. | |
| 6,063,827 | A | 5/2000 | Sacripante et al. | |
| 6,673,500 | B1 | 1/2004 | Patel et al. | |
| 6,970,259 | B1 | 11/2005 | Lunt et al. | |
| 7,312,011 | B2 | 12/2007 | Patel et al. | |
| 7,329,476 | B2 | 2/2008 | Sacripante et al. | |
| 2005/0019603 | A1 | 1/2005 | Kathirgamanathan | |
| 2005/0221209 | A1 | 10/2005 | Golodetz et al. | |
| 2006/0216626 | A1 | 9/2006 | Sacripante et al. | |
| 2007/0207397 | A1 | 9/2007 | Julien | |
| 2007/0231725 | A1* | 10/2007 | Riley et al. | 430/108.2 |
| 2007/0262579 | A1 | 11/2007 | Bala et al. | |
| 2008/0087190 | A1 | 4/2008 | Iftime et al. | |
| 2008/0107990 | A1 | 5/2008 | Field et al. | |
| 2008/0110995 | A1* | 5/2008 | Iftime et al. | 235/491 |
| 2008/0131802 | A1* | 6/2008 | Mizutani et al. | 430/109.4 |
| 2008/0193869 | A1* | 8/2008 | Vanbesien et al. | 430/108.4 |
| 2008/0277626 | A1 | 11/2008 | Yang et al. | |
| 2009/0045360 | A1* | 2/2009 | Wosnick et al. | 250/586 |
| 2009/0047593 | A1 | 2/2009 | Vanbesien et al. | |
| 2009/0061349 | A1* | 3/2009 | Sacripante et al. | 430/137.14 |
| 2009/0214972 | A1 | 8/2009 | Wosnick et al. | |

FOREIGN PATENT DOCUMENTS

| | | |
|---|---|---|
| EP | 1 837 708 A1 | 9/2007 |
| JP | A 10-107970 | 4/1998 |
| JP | A 2004-037563 | 2/2004 |
| JP | A 2004-037564 | 2/2004 |

OTHER PUBLICATIONS

Kazmaier et al., U.S. Appl. No. 12/234,110, filed Sep. 19, 2008.
Iftime et al., U.S. Appl. No. 12/634,979, filed Dec. 10, 2009.
European Search Report mailed Jan. 19, 2010.
Office Action, mailed Nov. 22, 2012, issued in U.S. Appl. No. 12/234,110.
Office Action, mailed Feb. 22, 2012, issued in U.S. Appl. No. 12/234,110.
Canadian Office Action mailed Apr. 12, 2011, issued in Canadian Patent Application No. 2,678,386.
U.S. Office Action dated May 16, 2013 from U.S. Appl. No. 13/483,864.
Office Action dated Jan. 3, 2013 issued in U.S. Appl. No. 13/483,864.
Office Action issued Oct. 4, 2013 in U.S. Appl. No. 13/483,864.
Office Action dated Feb. 5, 2014 issued in U.S. Appl. No. 13/483,864.

* cited by examiner

*Primary Examiner* — Mark F Huff
*Assistant Examiner* — Rashid Alam
(74) *Attorney, Agent, or Firm* — Pillsbury Winthrop Shaw Pittman LLP

(57) ABSTRACT

A low melt or ultra low melt toner includes at least one amorphous polyester of an alkoxylated bisphenol based polyester, a crystalline polyester derived from the reaction of an aliphatic dicarboxylic acid or aromatic dicarboxylic acid with an aliphatic diol, at least one colorant and at least one fluorescence agent. Methods of authentication of the toner, of authentication of documents formed from the toner, of embedding information in documents, and the like are also set forth.

8 Claims, No Drawings

LOW MELT COLOR TONERS WITH FLUORESCENCE AGENTS

CROSS-REFERENCE TO RELATED APPLICATION

This application is a continuation-in-part (CIP) application of application Ser. No. 12/234,110 filed Sep. 19, 2008. The entirety of the prior application is incorporated herein by reference.

BACKGROUND

Described herein are low melt color toners, particularly ultra low melt color toners, comprised of a crystalline polyester resin binder and an amorphous polyester resin binder together with at least one fluorescence agent and at least one colorant. Each of the toners containing a fluorescence agent exhibits a first visible color under ambient light conditions, and a different color upon exposure to activating energy to which the fluorescence agent is sensitive, such as ultraviolet (UV) light. The different color is the result of the fluorescence agent fluorescing upon exposure to the activating energy to which it is sensitive. This characteristic can be used advantageously in several different respects, including enabling the toner to be verified as authentic, enabling printing of images that exhibit different color appearances in different light conditions (ambient and fluorescing light conditions), enabling images to include information viewable only under fluorescing light conditions, and the like. For example, the toners with the fluorescence agent may be used to include security features in a document, including features to verify the authenticity of the document and/or to include digitally stored, machine readable or encrypted information in the document. Another advantage is represented by the possibility of printing customized security content on various forms and documents, a process known as Variable Data Printing, which is enabled by digital printing of security features. This is advantageous because it makes counterfeiting of documents very difficult because each printed document must be attempted to be copied individually. The security information may be hidden in the document until exposed to activating energy or radiation such as UV light that causes the fluorescence agent to illuminate or fluoresce. The security information can then be viewed to verify the authenticity, or can be machine read to decode digitally stored encrypted information. The security information cannot be copied with existing photocopiers. Other advantages are apparent from the description herein.

REFERENCES

U.S. Pat. No. 7,312,011, incorporated herein by reference in its entirety, describes a toner that includes a toner binder of crystalline sulfonated polyester, wherein the crystalline sulfonated polyester is 90% by weight or more of the toner binder, and a colorant. The toner may also include a linear amorphous sulfonated polyester, with the crystalline sulfonated polyester being from about 20% to about 60% by weight of the toner binder and the linear amorphous sulfonated polyester being from about 40% to about 80% by weight of the toner binder. The toners possess excellent minimum fixing temperatures in the range of from about 80° C. to about 130° C.

U.S. Pat. No. 6,673,500 describes a process comprising applying a toner security mark on a document generated by xerographic means, and which mark possesses white glossy characteristics. The toner is comprised of a waterborne polymer resin and a colorant, and optionally a second security mark generated by a toner comprised of a waterborne polymer resin and a UV fluorescent component.

U.S. Patent Application Publication No. 2009/0045360, incorporated by reference herein in its entirety, describes a luminescent ink marking material that includes a luminescent material, which includes quantum dots, and a vehicle for delivering the luminescent material to an object. Also described is a method of embedding information on a substrate that includes assigning information to luminescent material, which includes quantum dots, forming luminescent marking material by combining luminescent material and marking material, and creating an image on a substrate with the luminescent marking material. A system that embeds and recovers information on a substrate includes an image forming device containing such a luminescent marking material for forming an image on the substrate and a document reading device including a radiation emitting unit, which emits radiation that causes the luminescent marking material to illuminate, and a reader that detects the data on the substrate while the luminescent marking material is illuminated, is also described.

U.S. Patent Application Publication No. 2008/0110995, incorporated by reference herein in its entirety, describes a method of embedding machine readable information on a substrate, including converting the information to machine readable code format and writing the machine readable code format on the substrate with at least one fluorescent marking material. Also disclosed is a system for embedding and recovering machine readable information on a substrate, including an image forming device containing at least one fluorescent marking material, wherein the image forming device receives data representative of the machine readable information, and forms an image corresponding to the data in a machine readable code format with the at least one fluorescent marking material on an image receiving substrate, and a document reading device including a radiation emitting unit that emits radiation effecting fluorescence of the at least one fluorescent marking material, and a reader that detects the data in the image on the image receiving substrate while the at least one fluorescent marking material is fluorescing.

U.S. Patent Application Publication No. 2009/0214972, incorporated by reference herein in its entirety, describes toner compositions and methods for preparing the same, in which the toner may include a toner particle including a resin, at least one fluorescent agent including a lanthanide complex having a lanthanide ion and a ligand, and an optional wax and/or an optional pigment.

U.S. patent application Ser. No. 12/634,979, incorporated by reference herein in its entirety, describes a clear or colorless toner comprised of at least one amorphous resin, at least one crystalline resin, at least one component capable of emitting light upon exposure to ultraviolet light at a wavelength of from about 10 nm to about 400 nm, and optionally, one or more ingredients such as waxes, coagulants, and combinations thereof.

Fluorescent marks such as described in U.S. Patent Application Publication No. 2007/0262579, incorporated by reference herein in its entirety, are an excellent security feature. As the four colors cyan, yellow, magenta and black are typically used to determine the color space, there are many color combinations in the color space for providing exactly the same color. Fluorescent marks can take advantage of this by using two different color combinations to provide exactly the same color, but which have very different UV behavior. This may be done by controlling the paper area coverage and creating a high fluorescent signal for combinations that expose the maximal amount of paper. This combination provides a uniform color to the viewer under visible light, but under black light, fluorescence from the paper provides a visible graphic or text image. The security image is able to contain variable data through the use of "pattern ink" constructs in standard Page Description Languages.

While the above-described toners are suitable for their intended purpose, what is still desired is low melt color toners capable of achieving one or more of the advantageous properties indicated above.

SUMMARY

A toner is described that is comprised of toner particles comprising at least one amorphous polyester comprised of an alkoxylated bisphenol based polyester, a crystalline polyester derived from the reaction of an aliphatic dicarboxylic acid or aromatic dicarboxylic acid with an aliphatic diol, at least one colorant and at least one fluorescence agent.

Also described is a method for authentication of a toner, comprising forming a toner comprised of toner particles comprising at least one amorphous polyester, at least one crystalline polyester, at least one colorant and at least one fluorescence agent, wherein the color exhibited by the at least one fluorescence agent upon exposure to activating energy to which the at least one fluorescence agent is sensitive such that is fluoresces is known, exposing the toner to the activating energy to which the at least one fluorescence agent is sensitive such that is fluoresces, and determining if the toner exhibits the known color of the at least one fluorescence agent during exposure by comparing the exhibited color to the known color.

Further described is a method of forming an image, comprising: with a toner set comprised of a plurality of toners, a first toner of the toner set comprised of toner particles comprising at least one amorphous polyester, at least one crystalline polyester, at least one colorant and at least one fluorescence agent, wherein upon exposure to activating energy, the fluorescence agent fluoresces to cause a visible change in the color of a pattern formed in an image by the at least one toner, forming a latent image of a first pattern on a photoreceptor, developing the first pattern with the first toner, and subsequently transferring the developed first pattern to a recording medium, and forming a latent image of a second pattern on a photoreceptor, developing the second pattern with an additional toner different from the first toner, and subsequently transferring the developed second pattern to the recording medium.

EMBODIMENTS

Described herein are low melt toners, and in particular ultra low melt emulsion aggregation toners, that comprise toner particles comprised of a crystalline polyester resin binder and an amorphous polyester resin binder together with at least one fluorescence agent and at least one colorant. The toners may also include additional optional ingredients, for example including a wax. The toners are thus color toners that contain a fluorescence agent that upon exposure to activating energy to which the fluorescence agent is sensitive results in a bright emissive image of a color different from a color exhibited under ambient light conditions by an image formed by the toners. Images formed from the toners and under ambient light conditions may exhibit a substantially same color and gloss response as that of an image formed from a similar toner but not containing the fluorescence agent. The toners containing the fluorescence agent may thus be used to form a toner set, enabling security features to be formed in an image derived from the set of toners.

The low melt toners herein have a low melting, and thus low fixing, temperature as a result of the use of the crystalline resin. By low melting or ultra low melting toner is meant a toner that exhibits a low minimum fixing temperature of from about 70° C. to about 190° C., including from about 80° C. to about 180° C. and from about 80° C. to about 120° C.

The toners herein include a binder resin suitable for use in forming a low melt or ultra low melt toner. Suitable resins include a mixture of an amorphous polyester resin and a crystalline polyester resin.

In embodiments, the polymers utilized to form the amorphous and crystalline polyester resins may be, for example, sulfonated or non-sulfonated. The linear and/or branched amorphous resin and the crystalline resin may each be alkali sulfonated polyester resins or non-sulfonated aliphatic or aromatic polyester resins. The alkali metal in the respective sulfonated polyester resins may independently be, for example, lithium, sodium, or potassium.

In embodiments, the resins may be formed by reacting a diol with a diacid or diester in the presence of an optional catalyst.

In embodiments, the toner composition may include at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used hereinafter, "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

For forming a crystalline polyester, suitable organic aliphatic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of aliphatic dicarboxylic acids or aromatic dicarboxylic acids selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, diesters or anhydrides thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Specific polyester crystalline resins include, for example, poly(ethylene-adipate), polypropylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly (pentylene-sebacate), poly(hexylene-sebacate), poly (octylene-sebacate), alkali copoly(5-sulfoisophthaloyl)-copoly(ethylene-adipate), poly(decylene-sebacate), poly (decylene-decanoate), poly-(ethylene-decanoate), poly-(ethylene-dodecanoate), poly(nonylene-sebacate), poly (nonylene-decanoate), copoly(ethylene-fumarate)-copoly (ethylene-sebacate), copoly(ethylene-fumarate)-copoly (ethylene-decanoate), copoly(ethylene-fumarate)-copoly (ethylene-dodecanoate), and combinations thereof.

The crystalline resin may be present, for example, in an amount of from about 5 to about 50 percent by weight of the toner components, in embodiments from about 5 to about 30 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight (Mw) of, for example, from about 2,000 to about 100,000, in embodiments from about 2,000 to about 80,000, in embodiments from about 3,000 to about 40,000, in embodiments from about 10,000 to about 30,000 and in embodiments from about 21,000 to about 24,000 as determined by Gel Permeation Chromatography using polystyrene standards. The molecular weight distribution (Mw/Mn) of the crystalline resin may be, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Suitable crystalline polyester resins include those disclosed in U.S. Pat. No. 7,329,476 and U.S. Patent Application Pub. Nos. 2006/0216626, 2008/0107990, 2008/0236446 and 2009/0047593, each of which is hereby incorporated by reference in their entirety. In embodiments, a suitable crystalline resin may include a resin composed of ethylene glycol or nonanediol and a mixture of dodecanedioic acid and fumaric acid co-monomers with the following formula (I):

(I)

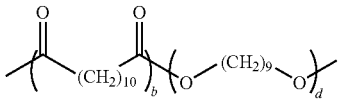

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly (decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), poly(p-xylylene pimelamide), and combinations thereof.

A crystalline polyester resin in a toner particle of the present disclosure may be present in an amount of from about 1 to about 15 percent by weight, in embodiments from about 5 to about 10 percent by weight, and in embodiments from about 6 to about 8 percent by weight, of the toner particles (that is, toner particles exclusive of external additives and water).

The resin utilized in forming a toner includes an amorphous polyester resin. In embodiments, the resin may be a polyester resin formed by reacting a diol with a diacid or diester in the presence of an optional catalyst.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include aliphatic diols with from about 2 to about 36 carbon atoms, such as 1,2-ethanediol, 1,3-propanediol, 1,2-butanediol, 1,3-butanediol, 1,4-butanediol, 1,5-pentanediol, 1,6-hexanediol, 1,8-octanediol, 1,9-nonanediol, 1,10-decanediol, and the like; 2,2-dimethylpropanediol, 2,2,3-trimethylhexanediol, 1,7-heptanediol, 1,12-dodecanediol, bis (hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected may vary, and may be present, for example, in an amount from about 40 to about 60 mole percent of the resin, in embodiments from about 42 to about 55 mole percent of the resin, in embodiments from about 45 to about 53 mole percent of the resin.

Alkali sulfonated polyester resins may be useful in embodiments, such as the metal or alkali salts of copoly (ethylene-terephthalate)-copoly(ethylene-5-sulfoisophthalate), copoly(propylene-terephthalate)-copoly(propylene-5-sulfoisophthalate), copoly(diethylene-terephthalate)-copoly (diethylene-5-sulfoisophthalate), copoly(propylene-diethylene-terephthalate)-copoly(propylene-diethylene-5-sulfoisophthalate), copoly(propylene-butylene-terephthalate)-copoly(propylene-butylene-5-sulfoisophthalate), and copoly(propoxylated bisphenol-A-fumarate)-copoly(propoxylated bisphenol A-5-sulfoisophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary amorphous polyester resins include alkoxylated bisphenol based polyesters such as poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly(propoxylated bisphenol A co-fumarate)-terpoly(propoxylated bisphenol A co-terephthalate)-terpoly(propoxylated bisphenol A co-dodecylsuccinate) and combinations thereof. In embodiments, the amorphous resin utilized in the core may be linear.

In embodiments, a suitable amorphous polyester resin may be a copoly(propoxylated bisphenol A co-fumarate)copoly(propoxylated bisphenol A co-terephthalate) resin having the following formula (II):

(II)

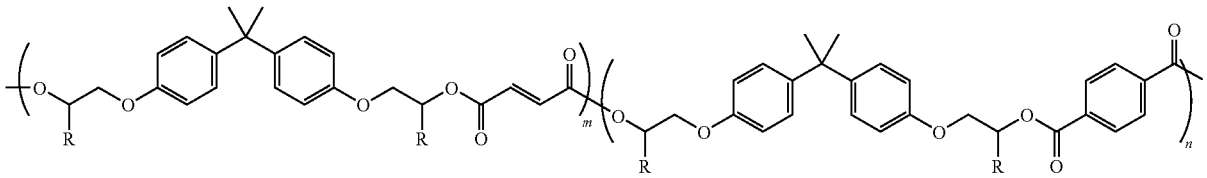

wherein R may be hydrogen or a methyl group, and m and n represent random units of the copolymer and m may be from about 2 to 10, and n may be from about 2 to 10. Other suitable resins include one of the terpolyesters set forth below in formula (III)

(III)

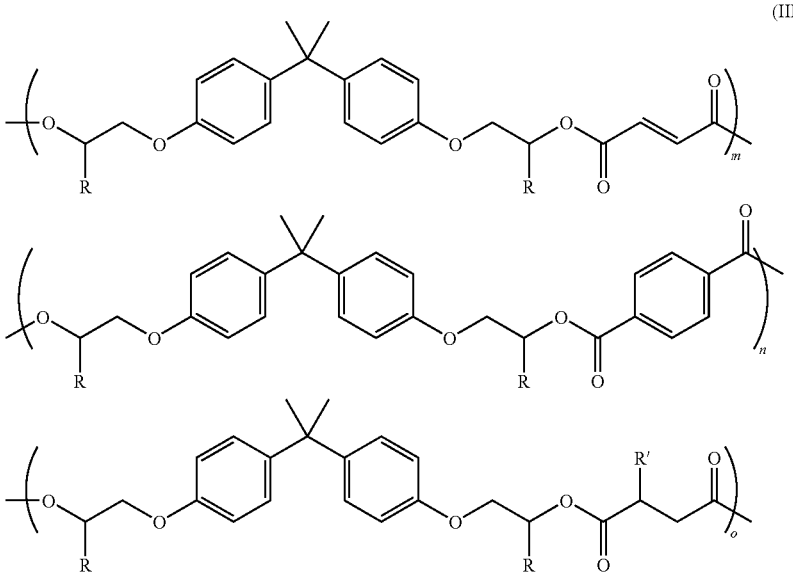

wherein R is hydrogen or a methyl group, R' is an alkyl group from about 2 to about 20 carbon atoms, and m, n and o represent random units of the copolymer and m may be from about 2 to 10, n may be from about 2 to 10, and o from about 2 to about 10.

An example of a linear copoly(propoxylated bisphenol A co-fumarate)-copoly(propoxylated bisphenol A co-terephthalate) resin that may be utilized as a binder resin is available under the trade name SPARII from Resana S/A Industrias Quimicas, Sao Paulo, Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

In embodiments, the amorphous resin(s) may be present, for example, in an amount of from about 30 to about 95 percent by weight of the toner components, in embodiments from about 40 to about 80 percent by weight of the toner components. A suitable amorphous resin utilized in a toner of the present disclosure may have a molecular weight of from about 2,000 to about 150,000, in embodiments from about 18,000 to about 85,000.

One, two, or more resins may be used in forming a toner. In embodiments where two or more resins are used, the resins may be in any suitable ratio (for example, weight ratio) such as, for instance, from about 1% (crystalline resin)/99% (amorphous resin) to about 99% (crystalline resin)/1% (amorphous resin), in embodiments from about 5% (crystalline resin)/95% (amorphous resin) to about 90% (crystalline resin)/10% (amorphous resin). In some embodiments, the weight ratio of the resins may be from about 99% to about 90% of the amorphous resin, to from about 1% to about 10% of the crystalline resin.

In embodiments, a suitable toner of the present disclosure may include two amorphous polyester resins and a crystalline polyester resin. The weight ratio of the three resins may be from about 29% of a first high molecular weight amorphous resin/69% second low molecular weight amorphous resin/2% crystalline resin, to about 60% first high molecular weight amorphous resin/20% second low molecular weight amorphous resin/20% crystalline resin.

Where two amorphous polyester resins are utilized, one of the amorphous polyester resins may be of high molecular weight, with the second amorphous polyester resin being of low molecular weight. As used herein, a high molecular weight amorphous resin has a weight average molecular weight ($M_w$) greater than 50,000, such as from about 50,000 to about 150,000, in embodiments from about 50,000 to about 100,000, in other embodiments from about 60,000 to about 94,000, in other embodiments from about 60,000 to about 85,000, as determined by gel permeation chromatography (GPC), using polystyrene standard. The high molecular weight amorphous polyester resins may have an acid value of from about 8 to about 20 mg KOH/grams, in embodiments from about 9 to about 16 mg KOH/grams, and in other embodiments from about 11 to about 15 mg KOH/grams. The high molecular weight amorphous polyester resins, which are available from a number of sources, may possess various onset glass transition temperatures of, for example, from about 50° C. to about 65° C., in embodiments from about 55° C. to about 160° C., and a softening point of from about 105° C. to about 150° C., in embodiments from about 110° C. to about 130° C.

The high molecular weight amorphous polyester resin is desirably a branched or cross-linked amorphous polyester resin. In embodiments, the resin may be a polyester resin formed by reacting a diol with a diacid or diester, as discussed above, and further with a branching agent. The high molecular weight resin may thus include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

Branched herein refers to a polymer that is not linear, but which has side chains branching off from the main polymer backbone. The branching point in a polymer is produced when a tri-functional or multi-functional reagent is incorporated into the main chain so as to enable growth in three or more directions. A branched polymer is not necessarily a crosslinked network. It depends on the degree of branching. The branches may be long or short. A branched polymer is not the same as a gel or cross-linked polymer network. For example, 10 to 100% by weight, such as 20 to 80% by weight, of the linear amorphous polyester may be replaced with a branched amorphous polyester, if desired. The inclusion of branched polyester portions may be used to impart elasticity to the binder, which improves the toner offset properties while not substantially affecting the minimum fixing temperature (MFT). For the branched amorphous polyester resin, the same materials may be used for forming the amorphous polyester above, with the further inclusion of a branching agent.

Branching agents for use in forming the branched or cross-linked amorphous polyester include, for example, tri-functional or higher functional acids or tri-functional or higher alcohols. Trimellitic acid is an example of a tri-functional acid. Additional examples of multivalent polyacids include 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof. Examples of multivalent polyols include sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected may be, for example, from about 0.1 to about 5 mole percent of the resin.

As used herein, a low molecular weight amorphous polyester resin has a weight average molecular weight ($M_W$) of 50,000 or less such as from about 2,000 to about 50,000, in embodiments from about 3,000 to about 40,000, in embodiments from about 10,000 to about 30,000, and in other embodiments from about 18,000 to about 21,000, as determined by GPC using polystyrene standards. The low molecular weight amorphous polyester resins may have an acid value of from about 8 to about 20 mg KOH/grams, in embodiments from about 9 to about 16 mg KOH/grams, in other embodiments from about 10 to about 14 mg KOH/grams. The low molecular weight amorphous resins can possess various onset glass transition temperatures (Tg) of, for example, from about 40° C. to about 80° C., in embodiments from about 50° C. to about 65° C., in other embodiments from about 55° C. to about 62° C., as measured by differential scanning calorimetry (DSC). The low molecular weight amorphous resin may possess a softening point of from about 90° C. to about 105° C., in embodiments from about 95° C. to about 100° C. The low molecular weight amorphous polyester resin may be similar in composition to the high molecular weight amorphous polyester resin, but is free of branching agents.

In embodiments, the amorphous polyester resin is desirably a combination of two amorphous resins, and a suitable crystalline polyester resin derived from the reaction of ethylene glycol and a mixture of dodecanedioic acid and fumaric acid co-monomers. In particular, the amorphous polyester resin may be a combination of a low molecular weight resin derived from terephthalic acid, fumaric acid, dodecylsuccinic acid and propoxylated bisphenol A and the high molecular weight resin derived from terephthalic acid, dodecylsuccinic acid, trimellitic acid (branching agent), propoxylated bisphenol A and ethoxylated bisphenol A. Derived from here means the reaction product of the identified materials. The chemistry of the two amorphous resins thus may be similar. The high Mw resin may have the lower Tg and the low Mw resin may have the higher Tg. The ratio of the amorphous resins may most desirably be 50:50, although a ratio range of 20:80 to 80:20 is also possible.

The crystalline and amorphous polyester materials of the binder may each be the same or different among toners of a toner set.

Polycondensation catalysts which may be utilized for forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

As noted above, in embodiments, the resin may be formed by emulsion aggregation methods. Utilizing such methods, the resin may be present in a resin emulsion, which may then be combined with other components and additives to form a toner of the present disclosure.

In embodiments, resins, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized in making an emulsion. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

In addition to the aforementioned toner binders, the toners also each include at least one colorant. Various known suitable colorants, such as dyes, pigments, and mixtures thereof, may be included in the toner in an effective amount of, for example, about 1 to about 25 percent by weight of the toner, and such as in an amount of about 1 to about 15 weight percent by weight of the toner.

The at least one colorant is desirably a non-fluorescent colorant. The colorant of the toners of the toner set including a fluorescence agent should be a pigment. This is because when pigments are used for providing color, and the fluorescence agent is dispersed in the toner binder, there is always sufficient room between the pigment particles to permit light to reach the fluorescence agent. This may not always be the case when using a dye as the colorant, which are dispersed the same as the fluorescence agent in the toner binder and thus may not allow sufficient light to reach the fluorescence agent, particularly for a darkly colored toner such as a black toner. Fluorescence may thus not be properly realized.

While the colorant of toners of the toner set not containing a fluorescence agent may use a non-pigment colorant, it is desired that all toners of the toner set include a pigment colorant so that regardless of the order in which the toners are printed onto the recording media, light will be able to reach the fluorescence agent so that the desired fluorescence can be realized.

As examples of suitable colorants, mention may be made of carbon black such as REGAL 330; magnetites, such as Mobay magnetites MO08029, MO8060; Columbian magnetites; MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like. As colored pigments, there can be selected cyan, magenta, yellow, red, green, brown, blue or mixtures thereof. Specific examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK, and cyan components may also be selected as colorants.

Other known colorants can be selected, such as Levanyl Black A-SF (Miles, Bayer) and Sunsperse Carbon Black LHD 9303 (Sun Chemicals).

In the toners of the toner set including a fluorescence agent, the fluorescence agent is a material that responds to activating energy, such as ultraviolet or black light, to emit light or fluoresce at a different color than the material exhibits at ambient light. The activating energy may be, for example, a radiation source having a wavelength from about 10 nm to about 1100 nm, such as from about 10 nm to about 400 nm or from about 200 nm to about 395 nm. The activating energy may thus be in the ultraviolet (UV), visible or infrared regions, although the use of activating radiation in the UV region (from about 100 nm to about 400 nm) is most common. The fluorescence may occur instantaneously on exposure to the activating energy, or may occur after overcoming any activation phase. The fluorescence exhibited may be reversible, but should last for a time period permitting the color change or image appearance change to be detected, for example a time frame of from about 0.5 seconds to about 1 hour, such as from about 1 second to about 45 minutes or from about 5 seconds to about 30 minutes.

A total amount of the fluorescence agent in a toner may comprise from about 0.1% to about 25% by weight of the total weight of the toner.

Suitable fluorescence agents include, for example, organic dyes such as fluorescent dyes, fluorescent pigments and inorganic surface functionalized quantum dot materials. Examples of fluorescent dyes suitable for use herein include those belonging to the dye families known as rhodamines, fluoresciens, coumarins, napthalimides, benzoxanthenes, acridines, azos, mixtures thereof and the like. Suitable fluorescent dyes include, for example, Basic Yellow 40, Basic Red 1, Basic Violet 11, Basic Violet 10, Basic Violet 16, Acid Yellow 73, Acid Yellow 184, Acid Red 50, Acid Red 52, Solvent Yellow 44, Solvent Yellow 131, Solvent Yellow 85, Solvent Yellow 135, solvent Yellow 43, Solvent Yellow 160, Fluorescent Brightener 61, mixtures thereof and the like. Suitable fluorescent pigments include those available from Day-Glo Color Corp., such as aurora pink T-11 and GT-11, neon red T-12, rocket red T-13 or GT-13, fire orange T-14 or GT-14N, blaze orange T-15 or GT-15N, arc yellow T-16, saturn yellow T-17N, corona magenta GT-21 and GT-17N, mixtures thereof and the like. Other suitable fluorescent pigments available from Risk Reactor are for example PFC class, like for example PFC-03 which switches from invisible to red when exposed to UV light, PF class like for example PF-09 which switches from invisible to violet when exposed to UV light. Other suppliers of fluorescent materials include Beaver Luminescers from Newton, Mass. and Cleveland Pigment &Color Co. form Akron, Ohio.

In embodiments, suitable fluorescence agents include, for example, 4,4'-bis(styryl)bipheny-1,2-(4-phenylstilben-4-yl)-6-butylbenzoxazole, 2-(2-hydroxyphenyl)benzothiazole, beta-methyl umbelliferone, 4-methyl-7-dimethylaminocoumarin, 4-methyl-7-aminocoumarin, N-methyl-4-methoxy-1,8-naphthalimide, 9,10-bis(phenethynyl)anthracene, 5,12-bis(phenethynyl)naphthacene, DAYGLO INVISIBLE BLUE™ A-594-5, combinations thereof, and the like. Other suitable fluorescence agents include, for example, 9,10-diphenyl anthracene and its derivatives, N-salicylidene-4-dimethylaminoaniline, 2-(2-hydroxyphenyl)benimidazole, 2-(2-hydroxyphenyl)benzoxazole, combinations thereof, and the like.

Dyes that exhibit a color under ambient light may be used, and include oil and solvent based dyes like DFSB class, DFWB class, DFPD class, DFSB-K class and the like available from Risk Reactor, such as DFWB-K41-80 that is red in ambient light and that fluoresces red-purple under UV light, DFSB-K401 that is red-purple in ambient light and that fluoresces red-purple under UV light, DFSB-K400 that has a brown appearance in ambient light and that fluoresces orange under excitation with UV light, DFSB-K427 that is orange under ambient light and under exposure to UV light, and DFSB-K43 that is yellow in ambient light and under exposure to activating UV light.

Still other suitable fluorescence agents include lanthanide coordination complexes. Lanthanide complexes for use as invisible fluorescent agents may be prepared from any of the lanthanide elements. In embodiments, the fluorescence agent may be prepared from praseodymium, neodymium, samarium, europium, gadolinium, terbium, dysprosium, holmium, erbium, thulium and ytterbium. In practice, lanthanide ions do not absorb exciting light efficiently. Combining the lanthanide ions with a ligand, in embodiments an organic ligand, may allow the resulting complex to absorb light and transfer energy to the lanthanide ions. The lanthanide complexes of the present disclosure thus appear colorless under normal light but undergo energy transfer when bound to lanthanide ions, leading to fluorescence at a wavelength widely separated from that of the absorbed light.

Various types of organic ligands may be used to form suitable lanthanide complexes, such as bis(pyrazolyl)pyridine, tris(2,2,6,6-tetramethyl-3,5-heptanedionato) chelate, tris(2,2,6,6-tetrakis(trifluoromethyl)-3,5-heptanedionato) chelate, combinations thereof, and the like. Examples of suitable methods for forming lanthanide complexes include those disclosed in U.S. Pat. No. 5,435,937, the disclosure of which is hereby incorporated by reference in its entirety.

Specific examples of suitable lanthanide complexes include DFKY-C7 and DFSB C7 lanthanide fluorescent agents, commercially available from Risk Reactor, Huntington Beach, Calif.

Quantum dot materials are fluorescent inorganic semiconductor nanoparticle materials. The light emission of quantum dots is due to quantum confinement of electrons and holes. An advantage of quantum dots is that they can be tuned so that they emit any desired wavelength (color) as a function of their size, by using one material only and the same synthetic process. For example in a range comprised from about 2 to about 10 nm, one can obtain a full range of colors from the visible range of the spectrum. In addition, quantum dots possess improved fatigue resistance when compared with organic dyes. Another advantage of quantum dots is their narrow emission bands, which increases the number of possible wavelength choices for designing customized colors. Quantum dots are available from a variety of companies, such as from Evident Technologies (Troy, N.Y.).

In embodiments, the quantum dot materials used herein are functionalized quantum dots. Surface functionalized quantum dots may have better compatibility with toner materials. Suitable functional groups present on the surface of the nanoparticle quantum dots for compatibility with toner include long linear or branched alkyl groups, for example from about 1 carbon atom to about 150 carbon atoms in length, such as from about 2 carbon atoms to about 125 carbon atoms or from about 3 carbon atoms to about 100 carbon atoms. Other suitable compatibilizing groups include polyesters, polyethers, polyamides, polycarbonates and the like.

In embodiments, the fluorescence agent may be added to a resin in a dispersion including a surfactant such as those described above. The fluorescence agent may be added to the resin utilized to form a toner composition described above utilizing any method within the purview of those skilled in the art including, but not limited to, for example, mixing, blending, combinations thereof, and the like. The combination of fluorescence agent and resin may then be utilized to form a toner.

The fluorescence of a toner possessing a fluorescence agent in accordance with the present disclosure can be tuned so that it appears upon exposure to UV light at a wavelength of from about 100 nm to about 800 nm, in embodiments from about 200 nm to about 750 nm, by using different fluorescence agents. Optional security levels may be designed based upon the selection and use of differing fluorescence agents and their emission of light at different wavelengths.

Under ambient light conditions, the colorant of the toner will exhibit a first color. The fluorescence agent desirably exhibits no color, or a clear color, under ambient light conditions. Under activating energy conditions to which the at least one fluorescence agent is sensitive such that is fluoresces (that is, upon exposure to activating energy), the fluorescence agent should then exhibit a second color different from the first color. In this way, the toner changes color appearance upon exposure to the activating energy.

The resin emulsions described above may be utilized to form toner compositions. Such toner compositions may include optional waxes, and other additives. Toners may be formed utilizing any method within the purview of those skilled in the art, including emulsion aggregation methods.

Optionally, a wax may also be combined with the resin and fluorescence agent in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14T™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

The toners may also optionally contain positive or negative charge enhancing additives, such as in an amount of about 0.1 to about 10, or from about 1 to about 3, percent by weight of the toner. Examples of these additives include quaternary ammonium compounds inclusive of alkyl pyridinium halides; alkyl pyridinium compounds, organic sulfate and sulfonate compositions, cetyl pyridinium tetrafluoroborates; distearyl dimethyl ammonium methyl sulfate; aluminum salts such as BONTRON E84 or E88 (Hodogaya Chemical); mixtures thereof; and the like.

There can also be blended with the toner compositions external additive particles including flow aid additives, which additives may be present on the surface of the toner particles. Examples of these additives include metal oxides like titanium oxide, tin oxide, mixtures thereof, and the like; colloidal silicas, such as AEROSIL, metal salts and metal salts of fatty acids inclusive of zinc stearate, aluminum oxides, cerium oxides, and mixtures thereof. Each of the external additives may be present in an amount of from about 0.1 percent by weight to about 5 percent by weight, and more specifically, in an amount of from about 0.1 percent by weight to about 1 percent by weight, of the toner. Several of the aforementioned additives are illustrated in U.S. Pat. Nos. 3,590,000, 3,800,588, and 6,214,507, the disclosures of which are totally incorporated herein by reference.

The toners may be made by a variety of known methods, but are desirably made by the known emulsion aggregation process in which small size resin particles in an emulsion including the other components of the toner are aggregated to the appropriate toner particle size and then coalesced to achieve the final toner particle shape and morphology.

The toners may be prepared by a process that includes aggregating a mixture of the polyester binders, the pigment colorant(s), the fluorescence agent(s), and any optionally wax(es) or other desired or required additives, and then coalescing the aggregate mixture. As a general example, a mixture is prepared by adding the colorant, any fluorescence agent and optionally a wax or other materials, to the emulsion, which may be a mixture of two or more emulsions containing the toner binder resins. In embodiments, the pH of the pre-toner mixture is adjusted to between about 4 to about 5. The pH of the pre-toner mixture may be adjusted by an acid such as, for example, acetic acid, nitric acid or the like. Additionally, in embodiments, the mixture optionally may be homogenized. If the mixture is homogenized, homogenization may be accomplished by mixing at about 600 to about 4,000 revolutions per minute. Homogenization may be accomplished by any suitable means, including, for example, an IKA Ultra Turrax T50 probe homogenizer.

In embodiments, the process includes a first step in which a fluorescent latex emulsion, including at least the fluorescence agent and at least one of the binder resins of the toner particles, is prepared by any suitable method, for example such as solvent flash. Desirably, the binder resin is one or all of the amorphous binder resins of the toner particles. The latex particles thus contain a polyester resin into which an organic fluorescent dye or pigment is incorporated.

In a second step, the fluorescent toner particles are prepared from the emulsion by adapting the emulsion aggregation process to the fluorescent materials set. In this regard, the colored pigment is added to the composition, which provides the toner with the color visible under normal light conditions. The toner color can be any color such as cyan, magenta, yellow, black, spot color and the like. In addition, any emitted color (when viewed under UV) can be generated by using a fluorescence agent with the appropriate emitted spectrum. Also added to the composition are the remaining binder components.

An aggregating agent (coagulant) may be added to the pre-aggregated emulsions. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent is added to the mixture at a temperature that is below the glass transition temperature (Tg) of the emulsion resin. The aggregating agent may be added in an amount of about 0.05 pph to about 3.0 pph with respect to multivalent cation and from about 1.0 to about 10 pph with respect to the divalent cation wherein the pph is with respect to weight of toner. The aggregating agent may be added to the mixture over a period of from about 0 to about 60 minutes. Aggregation may be accomplished with or without maintaining homogenization. Aggregation is accomplished at temperatures that are typically greater then 60° C.

In embodiments, the toner particles may have a core-shell structure, wherein the core is comprised of the binder, colorant and fluorescence agent, and the shell is comprised of additional binder and free of additional colorant. Desirably, the shell will contain only amorphous polyester binder and be free of crystalline polyester binder. If desired, additional fluorescence agent may be included in the shell.

The toner particles of all embodiments may be formulated into a developer composition, for example by mixing the toner particles with carrier particles to achieve a two-component developer composition. The toner concentration in each developer ranges from, for example, about 1% to about 25%, such as about 2% to about 15%, by weight of the total weight of the developer. Illustrative examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like.

The toners including a fluorescence agent therein may be used in a number of applications, discussed below. In embodiments, the presence of the fluorescence agent is not noticeable to a viewer when viewed in ambient light, but becomes noticeable when exposed to radiation at which the fluorescence agent fluoresces. Upon the toner, or an image/document formed using the toner, being removed from exposure to the activating radiation, the fluorescence agent once again returns to a non-fluorescing state. The change between the fluorescing state and the non-fluorescing state can be repeated an indefinite number of times, and for example from about 10 to about 100,000,000 times or more.

For example, the presence of a fluorescence agent in a regularly colored toner may be used to authenticate the original toner. In this way, a customer can ensure that they are using an authentic toner instead of a counterfeit toner. A customer is aware of the presence of the fluorescence agent in the authentic toner, and knows the color it is to emit under UV or black light, and thus can readily verify the toner's authenticity. Moreover, each customer may be provided a toner with a unique fluorescence agent, such that each customer may have a toner that is uniquely identifiable as authentic by that customer. For example, a given cyan toner may have one fluorescence agent for one customer such that it fluoresces a certain first color, and have a different fluorescence agent for another customer such that it fluoresces a certain second color different from the first color. Any emitted color may be achieved by using a fluorescence agent with an appropriate emitted spectrum.

In another example, a color toner for different customers may be provided with a same fluorescence agent in different amounts, or provided with two fluorescence agents in different ratios of agents. A customer could then measure the emitted color as well as the intensity of the emitted color (which allows the amount or ratio of fluorescence agents to be determined), providing a still further level of security in the ink. The difference in intensity should be measurably detectable upon fluorescence, such that the difference can be used to form the security feature. Measurably detectable refers to the difference in fluorescence being detected to be different by any suitable machine reading or sensing device, for example as are known in the art, or human.

In embodiments, the toners herein may be used in a toner set. A toner set includes a number of toners, such as at least two toners, for example from two to ten toners, from two to five toners or from two to four toners, wherein a substantially same color is achievable by at least two different groupings of toners of the toner set. In a full color system, typically at least four differently colored toners are used in the toner set, one for each of cyan (C), yellow (Y), magenta (M) and black (K). In embodiments herein, the toner set may also include a colorless toner in which the toner contains no colorant visible under ambient light conditions but does include a fluorescence agent.

In the toner sets herein, desirably each of the toners of the toner set include a colorant visible under ambient light conditions and a fluorescence agent that becomes visible under UV or black light conditions. The fluorescence agent desirably exhibits a color under the UV or black light conditions that is different from the color exhibited by the colorant of that toner.

By differently colored is intended that the toners exhibit a different color, that is, an absorption characteristic, different from each other under ambient versus UV light conditions, and thus do not have a substantially same color. A substantially same color refers to, for example, the two toner groupings each forming an image that has overall absorption characteristic within the visible range of wavelengths of the electromagnetic spectrum under normal, ambient light conditions, the color difference being substantially indiscernible to the naked human eye. In this regard, substantially same color may be thought of in terms of a CIELAB color space, in which the three coordinates of CIELAB represent the lightness of the color ($L^*=0$ yields black and $L^*=100$ indicates diffuse white), its position between red/magenta and green ($a^*$, negative values indicate green while positive values indicate magenta) and its position between yellow and blue ($b^*$, negative values indicate blue and positive values indicate yellow). A substantially same color may be two points on the color space wherein the values for L*, a* and b* for each point are each sufficiently close, for example differing by less than a predetermined ΔE number, where in an ideal situation values below 1 ΔE are considered identical to a human. However, in real world applications, this idealized value is commonly not achieved and a difference of 5 ΔE is often sufficient and in some cases even higher ΔE can be tolerated if sufficient visual distraction is encountered by the observer. Standard C, Y and M color toners absorb strongly in their respective frequency bands, but have a low absorbance outside that range. Black toner, however, has a fairly constant absorbance across the visible, the UV and the IR parts of the spectrum.

In embodiments, the toners may be used to provide secure or hidden information in a printed document. As an example, one or more toners of the toner set may not include a fluorescence agent. For example, in a full color toner set of CMYK, the black toner may be the only toner containing a fluorescence agent. Any of the other color toners may also be selected to contain a fluorescence agent. Hidden messages or codes as security information may be created in this example in black by forming an image with a mixture of cyan, magenta and yellow to provide a first black area. The hidden message may be printed with the fourth toner, black containing fluorescent materials. Under regular viewing conditions, the print appears as a black area or image. Under UV light, the hidden message becomes visible because it was printed with the black toner containing the fluorescence agent and thus fluoresces when exposed to the activating light.

This effect may be similarly achieved by printing an image with two different toners of a substantially same color, for example using two black toners, but only one of which contains a fluorescent material. In this way, the image will appear consistently black under ambient light, but portions may be made to appear a different color when exposed to UV or black light.

Still further, the use of the toners herein may be used to verify an authorized print or copy of a document. The authentic version will exhibit the fluorescing color upon exposure to UV or black light, whereas an unauthorized or fake copy will not be able to show the necessary fluorescing property.

The foregoing techniques can be used to provide authentication of a printed document. Printed documents that may benefit from protection offered by this security toner include labels and packages, legal documents like wills, transactional documents like credit card statements and bills, health documents like prescriptions, and others.

Encrypted messages or barcodes that cannot be understood or read under normal reading conditions but which are machine readable may also be made using the toners described herein. In this case, a detector is also providing the UV light needed for detection. The printed image may include barcodes or 2D barcodes or any other kind of codes formed using the toners with a fluorescence agent. For example, a document can display a colored regular barcode (for example printed with black toner). However, when exposed to UV light, a second barcode is revealed (created by selected codes that fluoresce under UV light, displaying additional information. This second barcode information cannot be copied with a regular copier, as discussed above.

In embodiments, the pattern formed by the toner containing the fluorescence agent may be machine-readable code storing digital data in the document. Digital data refers to, for example, information such as test or numeric characters in the form of a digital code representative of zeroes and one. The machine readable code format may be, for example, one dimensional barcode, two dimensional barcode, glyphs, dots, combinations thereof and the like. One-dimensional barcodes have a form such as used for UPC codes on products. The two dimensional barcode may be of any suitable type, such as, for example, PDF417 (based on stacked barcodes), 3-DI, Array Tag, Aztec code, Codablock, Code 16K, CP code, Data Matrix, Datastrip code, Maxicode, Minicode, and the like. The encoded information may also be in the form of data glyphs or dots. In glyphs code, the code format is a self-clocking glyph code as disclosed in, for example, U.S. Pat. Nos. 5,128,525 and 5,168,147, the disclosures of each of which are totally incorporated herein by reference. This code comprises printed glyphs which represent 0 and 1 bits in a document encoding scheme, such as/and \. Each symbol may represent one bit; for example, /=1 and \=0. In dot code, 0 s and 1 s are represented by the presence or absence of a dot. Dots refer to, for example, any mark of any shape, and include, for example, circular or rectangular marks.

For embedding digital data in the image, the printer has an associated encoding device, which receives the information to be encoded and encodes the information in a suitable machine-readable format. The encoded information is sent to the printer for printing onto the paper substrate using a toner containing a fluorescence agent. The device may also include a detector/reader for detecting and reading the hidden information when it is exposed by activation of the fluorescence agent. For this detection, the image is exposed to the activating energy to cause the fluorescence agent to emit light at a different color and, while still exhibiting the different color, detecting and reading the information with a detector/reader. The system may also include one or more processors, for example to convert information to the encoded information representative of the information, that is, to convert the information to a machine-readable code format. A similar processor may be used to decode encoded information detected by a reader, that is, convert the encoded information to its original uncoded information form, to recover the encoded information. The decoded information may be presented to a person in human-understandable format, which can confirm the authenticity of the image and/or document as well as inform of the hidden information contained in the document. One example use of this feature may be to encode the actual amount of a check, permitting detection of checks in which the actual amount may have been altered.

The toners may also be used to provide images having different color effects under ambient versus UV or black light. For example, where each of the color toners of the toner set includes a fluorescence agent, a resulting full color image printed with the color toners will have a first appearance under ambient light, but a different color appearance under UV light.

Each of the toners of the toner set, including two toners exhibiting substantially the same color, may be made to also exhibit substantially the same gloss in an image formed from the toners. As such, differential gloss realized such as when overcoating a formed image with a conventional clear overcoat or toner may be avoided. Gloss is a measure of an image's shininess, which should be measured after the image has been formed on a print sheet. Gloss may be measured using a Gardiner Gloss metering unit. In embodiments herein, each of the toners used in the toner set, including the two toners, are made to have substantially matched gloss. In this regard, each of the toners should achieve an image with a gloss within about 5 Gardiner gloss units (ggu) of each other, for example a gloss value within from 0 to about 5 ggus or from about 0.5 to about 3 ggus or from about 0.5 to about 2 ggus, of each other. In doing so, the formed image having fluorescent capabilities exhibits substantially no differential gloss, and thus the appearance of the image is uniform. The gloss exhibited by the toners herein may be stable across the fusing temperature range, and may be about 5 to about 75 Gardner gloss units (ggu), such as about 25 to about 50 ggu, as measured at 75° C., over a range of about 90° C. to about 210° C. fusing temperatures.

The toners desirably are able to be fixed onto paper at a fixing temperature such as of from about 70° C. to about 200° C., for example from about 70° C. to about 150° C. The lower the fusing temperature, the less power consumption required and the fuser system is able to possess extended lifetimes. For a noncontact fuser, that is a fuser that provides heat to the toner image on paper by radiant heat, the fuser usually is not in contact with the paper and the image. For a contact fuser, that is a fuser which is in contact with the paper and the image, the toners should not substantially transfer or offset onto the fuser roller, referred to as hot or cold offset depending on whether the temperature is below the fixing temperature of the paper (cold offset), or whether the toner offsets onto a fuser roller at a temperature above the fixing temperature of the toner (hot offset).

Fixing performance of a toner can be characterized as a function of temperature. The maximum temperature at which the toner does not adhere to the fuser roll is called the hot offset temperature (HOT). When the fuser temperature exceeds HOT, some of the molten toner adheres to the fuser roll during fixing and is transferred to subsequent substrates containing developed images, resulting for example in blurred images. This undesirable phenomenon is called offsetting. Less than the HOT of the toner is the minimum fixing temperature (MFT) of the toner, which is the minimum temperature at which acceptable adhesion of the toner to the support medium occurs, that is, as determined by, for example, a crease test. The difference between MFT and HOT is called the fusing latitude of the toner, that is, the temperature difference between the fixing temperature and the temperature at which the toner offsets onto the fuser. The fusing latitude should be as large as possible.

Toners herein may exhibit a minimum fixing temperature of from about 70° C. to about 150° C. The toners may exhibit a glass transition temperature of from about 45° C. to about 100° C. The present toners exhibit satisfactory properties when used in a xerographic or electrostatographic process. Such properties may include the gloss discussed above, good C-zone and A-zone charging, a fusing latitude of from about 15 to about 100° C., and substantially no vinyl offset.

The toners are each comprised of small sized toner particles, such as having average particle sizes of from about 3 to about 12 microns, such as from about 5 to about 9 microns. The toner particles may have a geometric size distribution (GSD) of about 1.05 to about 1.35, such as from about 1.10 to about 1.25, where the geometric size distribution is defined as the square root of D84 divided by D16. The particles have a relatively smooth particle morphology.

The toners of the toner set may be applied to a recording media, such as paper, plastic, cardboard, metal and the like, using any suitable xerographic or electrostatographic printing technique.

In embodiments, any known type of image development system may be used in an image developing device to form images with the toner set described herein, including, for example, magnetic brush development, jumping single-component development, hybrid scavengeless development (HSD), and the like. These development systems are known in the art, and further explanation of the operation of these devices to form an image is thus not necessary herein. It is sufficient to say that portions of an overall image may be formed by first forming a latent image pattern for a given toner color on a photoreceptor surface, developing the latent image, and then transferring the developed pattern to a recording media in order to form that color portion of an image. The image may be assisted in being fixed to the recording media by, following transfer to the recording media, utilizing a fuser roll member. Fuser roll members are contact fusing devices that are known in the art, in which heat and pressure from the roll are used in order to fuse the toner to the recording media such as paper. Typically, the fuser member may be heated to a temperature just above the fusing temperature of the toner, such as to temperatures of from about 70° C. to about 150° C. or more.

As the recording media, any suitable substrate material capable of being printed may be used, such as paper, plastic, cardboard, metal and the like. In embodiments, the recording media is paper. The paper may include optical brightening agents such as described in U.S. Patent Application Publication No. 2007/0262579, such that the image formed on the substrate may include the synergistic effect of the fluorescence from the fluorescence agent and the radiated fluorescence as a result of the optical brightening agent. Fluorescence marks formed on paper substrates having optical brighteners may be particularly advantageous as a result.

Embodiments described above will now be further illustrated by way of the following examples.

EXAMPLE 1

A colorless amorphous resin emulsion containing a fluorescence agent (that exhibits the color green under UV light) was prepared as follows:

A first solution was prepared by heating and mixing at 60° C. the following components: 120 g of an amorphous resin (propoxylated bisphenol A fumarate/terephthalate), 30 g of 2-(2-hydroxyphenyl)benzothiazole (green emitting fluorescent dye) and 1 kg of ethyl acetate solvent. A second solution was prepared by mixing 2.5 g of DOWFAX 2A1 (dispersant) in 850 g of distilled water. This second solution was warmed at 60° C., placed in a 4 L kettle and 2.5 g of a 30% concentration $NH_4OH$ in water were added. The second solution was homogenized while slowly pouring the first solution therein. As the viscosity increased, the rpm of the homogenizer was increased from low (4,000 rpm) to highest (10,000 rpm; at the end of the addition). After completing the addition, the mixture is homogenized for an additional 30 minutes at 10,000 rpm. To the kettle was added a distillation column and the organic solvent was distilled away. The lid was removed and the solution was let stirring overnight at room temperature. Finally, the emulsion was filtered through a 25 μm sieve. The emulsion had an average particle size of $d_{50v}$=217 nm and the solids content was 20.74%. It emitted bright green light when exposed to 365 nm UV.

EXAMPLE 2

A black ultra low melt toner derived from the emulsion of Example 1 is prepared as follows:

A 4 L kettle was filled with 71.6 g of a latex of a high molecular weight (Mw of about 70 kg/mol) polyester resin containing alkoxylated bisphenol A fumarate/terephthalate resin, 168.5 g of the emulsion from Example 1, 27.9 g of a crystalline polyester latex (Mw of about 21-27 kg/mol and Tm about 70-75° C.), 36.5 g of a polymethylene wax latex commercially available from IGI, 55.18 g of black pigment dispersion containing 7% pigment, 406.2 g of distilled water and 1.48 of DOWFAX 2A1. The pH was adjusted to 4.2. The solution is homogenized at 4,000 rpm and an aluminum sulphate solution was added dropwise (0.625 g dissolved in 61.7 g of water, overall). The rpm is slowly increased as the viscosity of the mixture increases. At the end of the addition, the mixture is homogenized for an additional 3 minutes. The kettle is heated under continuous stirring. The temperature is slowly raised until particle size of the toner was 5.42 μm. This is the toner particle core. Then a composition made of the following was added slowly: 46.19 g of a high molecular weight (Mw of about 70 kg/mol) amorphous latex, 53.35 g of a second low molecular weight (Mw of about 15-20 kg/mol) amorphous latex, 1.5 g of DOWFAX 2A1 and 40.46 g of distilled water. This material will form a shell around the core. When the particle size was 5.9 μm, 4.8 g of chelating agent was added, then pH was adjusted to 8.0 and the temperature was raised to 85° C., until a circularity of 0.963 was achieved. The toner mixture was poured over cold ice and stirred overnight. The toner was washed with a sequence of diluted acid and base solutions, filtered and freeze dried to provide a core-shell toner with a particle size of $d_{50v}$=6.08 μm.

EXAMPLE 3

Tests were Conducted as Follows:

Images were printed and fused in a Xerox DocuColor 250 machine under nominal electrostatic conditions. Images were formed with both standard black toner (a high gloss emulsion aggregation toner) and the toner of Example 2, each of which were present in separate print positions of the device so that a given image could comprise one or both of the toners. When viewed under normal light, the two black colors were essentially identical, except for a small difference in gloss that is due to different formulations.

Under normal viewing conditions, all the printed areas appear black, regardless of the toner(s) used to print the printed areas. It is practically impossible to figure out by human inspection alone which parts of the document were printed with the toner of Example 2 instead of just the standard toner. All areas printed with the security toner are revealed under exposure to UV light because they then exhibit green. Areas printed with the standard toner appear remain black under UV light (no color change). The color-changing feature also cannot be simulated with a second generation copy, making the original document extremely secure.

A secret message can be printed by using a combination of the fluorescent toner and the standard toner. The message can be detected only under UV light. The areas printed with the fluorescent toner appear green, while the rest appears black. Under normal room light, the secret message is invisible since the whole area appears like a solid black rectangle.

The standard black toner and the black fluorescent toner of Example 2 appear identical when viewed under regular light. However, when exposed to UV light, the standard toner appears black while the fluorescent black toner appears green.

The black fluorescent toner could be used instead of currently used regular colored toner. Under the normal use, there is no difference; they both work as regular colored toners. However, because of the fluorescence property, customers have the opportunity to authenticate whether the toner they are using is an original toner, by checking the color change under UV light. For customers, this will eliminate potential printing malfunctioning, or poor quality prints due to the use of a counterfeited product.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of forming an image, comprising:

with a toner set comprised of a plurality of toners, a first toner of the toner set comprised of toner particles comprising at least one amorphous polyester comprised of an alkoxylated bisphenol based polyester, at least one crystalline polyester derived from the reaction of an aliphatic dicarboxylic acid or aromatic dicarboxylic acid with an aliphatic diol, at least one colorant and at least one fluorescence agent, wherein the at least one colorant is a black pigment, the toner set further comprising a black toner free of fluorescence agents, wherein upon exposure to activating energy, the fluorescence agent fluoresces to cause a visible change in the color of a pattern formed in an image by the at least one toner, and wherein an image formed from the toner and under ambient light conditions exhibits a substantially same color and a substantially same gloss as that of an image formed from a same toner but not containing the at least one fluorescence agent when the image formed by the toner containing the at least one fluorescence agent and the image formed by the same toner without the at least one fluorescence agent is formed on a same substrate forming a latent image of a first pattern on a photoreceptor, developing the first pattern with the first toner, and subsequently transferring the developed first pattern to a recording medium, and forming a latent image of a second pattern on a photoreceptor, developing the second pattern with an additional toner different from the first toner, and subsequently transferring the developed second pattern to the recording medium.

2. A method for authentication of a toner set, comprising: forming a toner comprised of toner particles comprising at least one amorphous polyester comprises a copoly(propoxylated bisphenol A co-fumarate)-copoly(propoxylated bisphenol A co-terephthalate) having a repeating unit of the following formula (11):

(II)

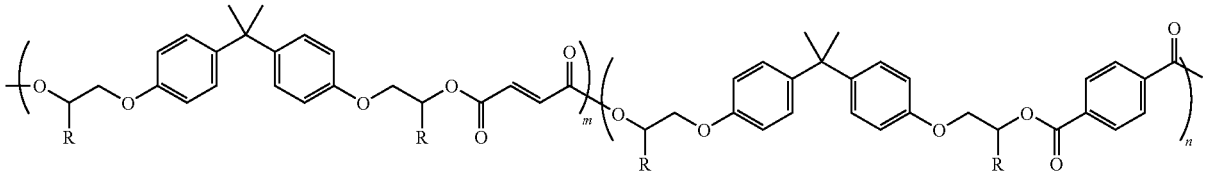

wherein R is hydrogen or a methyl group, and m and n represent random units of the polyester, wherein m is from about 2 to 10 and n is from about 2 to 10, at least one crystalline polyester, at least one colorant and at least one fluorescence agent, wherein the color exhibited by the at least one fluorescence agent upon exposure to activating energy to which the at least one fluorescence agent is sensitive such that its fluorescence is known, and wherein an image formed from the toner and under ambient light conditions exhibits a substantially same color and a substantially same gloss as that of an image formed from a same toner but not containing the at least one fluorescence agent when the image formed by the toner containing at least one fluorescence agent and the image formed by the same toner without the at least one fluorescence agent is formed on a same substrate exposing the toner to the activating energy to which the at least one fluorescence agent is sensitive such that it fluoresces, and determining if the toner exhibits the known color of the at least one fluorescence agent during exposure by comparing the exhibited color to the known color.

3. The method according to claim 2, wherein the intensity of fluorescence of the toner due to an amount of the at least one fluorescence agent in the toner is also known, and the determining includes measuring the intensity of the fluorescence of the toner during exposure to the activating energy and comparing the measured intensity to the known intensity.

4. A method of forming an image, comprising: with a toner set comprised of a plurality of toners, a first toner of the toner set comprised of toner particles comprising at least one amorphous polyester comprised of an alkoxylated bisphenol based polyester, at least one crystalline polyester derived from the reaction of an aliphatic dicarboxylic acid or aromatic dicarboxylic acid with an aliphatic diol, at least one colorant and at least one fluorescence agent, cyan, yellow and magenta toners free of fluorescence agents, wherein upon exposure to activating energy, the fluorescence agent fluoresces to cause a visible change in the color of a pattern formed in an image by the at least one toner, and wherein an image formed from the toner and under ambient light conditions exhibits a substantially same color and a substantially same gloss as that of an image formed from a same toner but not containing the at least one fluorescence agent when the image formed by the toner containing the at least one fluorescence agent and the image formed by the same toner without the at least one fluorescence agent is formed on a same substrate forming a latent image of a first pattern on a photoreceptor, developing the first pattern with the first toner, and subsequently transferring the developed first pattern to a recording medium, and forming a latent image of a second pattern on a photoreceptor, developing the second pattern with an additional toner different from the first toner, and subsequently transferring the developed second pattern to the recording medium.

5. The method according to claim 4, wherein the first toner and the additional toner exhibit a same color under ambient light, the additional toner differing from the first toner at least in being free of fluorescence agents, and the method further comprises exposing the developed patterns to the activating energy to initiate fluorescence of the fluorescence agent in the first pattern such that the first pattern exhibits a different color from the ambient light color.

6. The method according to claim 4, wherein the first toner and the additional toner exhibit a different color under ambient light, both the first toner and the additional toner contain a fluorescence agent, and the method further comprises exposing the developed patterns to the activating energy to initiate fluorescence of the fluorescence agent in the first and the second pattern such that both patterns exhibit a different color from the respective ambient light colors.

7. The method according to claim 4, wherein the first pattern or the second pattern is comprised of digital information.

8. The method according to claim 7, wherein the digital information is machine readable, and the method further comprises exposing the patterns to the activating energy to initiate fluorescence of the fluorescence agent in the first and/or the second pattern and reading the digital information with a machine during the fluorescence.

* * * * *